US009549623B1

(12) United States Patent
Snell et al.

(10) Patent No.: US 9,549,623 B1
(45) Date of Patent: Jan. 24, 2017

(54) EXPANDABLE PARTITIONING DEVICE

(71) Applicant: InterDesign, Inc., Solon, OH (US)

(72) Inventors: Russell Benton Snell, Bentleyville, OH (US); Terry Michael Bailey, Ravenna, OH (US)

(73) Assignee: InterDesign, Inc., Solon, OH (US)

( * ) Notice: Subject to any disclaimer, the term of this patent is extended or adjusted under 35 U.S.C. 154(b) by 0 days.

(21) Appl. No.: 14/851,615

(22) Filed: Sep. 11, 2015

Related U.S. Application Data

(60) Provisional application No. 62/049,464, filed on Sep. 12, 2014.

(51) Int. Cl.
*A47B 88/20* (2006.01)
*A47F 5/00* (2006.01)

(52) U.S. Cl.
CPC ..... *A47F 5/005* (2013.01); *A47B 88/20* (2013.01); *A47B 2088/202* (2013.01)

(58) Field of Classification Search
CPC ..... A47B 57/58; A47B 57/581; A47B 57/583; A47B 57/585; A47B 57/586; A47B 57/588; A47B 88/20; A47B 2088/202; A47B 2088/205; A47B 2088/207; A47F 5/005; A47F 5/0056; A47F 5/0062; B60P 7/15; B60R 13/01
USPC ..... 211/105.1, 105.3, 105.4, 184; 108/61; 410/151
See application file for complete search history.

(56) References Cited

U.S. PATENT DOCUMENTS 1,849,024 A * 3/1932 McKee ..... A47B 88/20 160/216
3,692,191 A * 9/1972 Moore ..... A47B 57/585 211/184
4,621,431 A * 11/1986 Fatool ..... G01B 3/08 33/296
4,889,253 A * 12/1989 Schmulian ..... A45C 13/02 220/551
5,443,342 A * 8/1995 Huang ..... B60P 7/15 254/247
5,803,276 A * 9/1998 Vogler ..... A47F 5/005 108/60
5,947,666 A * 9/1999 Huang ..... B60P 7/15 410/143
5,988,963 A * 11/1999 Shiau ..... B60P 7/15 410/143
6,109,847 A * 8/2000 Patel ..... B60R 7/02 410/121
6,227,781 B1 * 5/2001 Smith ..... B60P 7/15 410/149
6,247,882 B1 * 6/2001 Huang ..... B60P 7/15 410/143

(Continued)

FOREIGN PATENT DOCUMENTS

WO WO 2012/121453 * 9/2012 ..... A47B 88/20

*Primary Examiner* — Joshua Rodden
(74) *Attorney, Agent, or Firm* — Calfee, Halter & Griswold, LLP

(57) ABSTRACT

An expandable partitioning device includes a pair of slide bars. Each slide bar includes a pair of first cooperating surfaces for slideably connecting the other slide bar. The first slide bar has a plurality of recesses along its length. The second slide bar has a rotatable toggle switch with at least one locking member. When the toggle switch is engaged (rotated) the locking member(s) rotate into the recesses of the first slide bar, locking the relative positions of the two slide bars.

20 Claims, 6 Drawing Sheets

(56) References Cited

U.S. PATENT DOCUMENTS

| | | | | |
|---|---|---|---|---|
| 6,755,600 | B2 * | 6/2004 | Scott | B60P 7/15<br>410/151 |
| 8,556,092 | B2 * | 10/2013 | Valiulis | A47F 5/005<br>108/61 |
| 2003/0137227 | A1 * | 7/2003 | Hoenig | A47B 88/20<br>312/348.3 |

* cited by examiner

EXPANDABLE PARTITIONING DEVICE

CROSS-REFERENCE TO RELATED APPLICATION

This application claims priority to, and the benefit of, U.S. Provisional Patent Application Ser. No. 62/049,464, entitled "EXPANDABLE PARTITIONING DEVICE" and filed Sep. 12, 2014, the entire contents of which are incorporated herein by reference, to the extent that they are not directly conflicting with the present application.

TECHNICAL FIELD

The present invention relates generally to a partitioning device, and more particularly to expandable partitioning device for partitioning a compartment.

BACKGROUND OF THE INVENTION

Traditionally, partitioning devices for compartments, such as drawer dividers, rely on spring-compression force to hold the divider in place. A user of the device squeezes the divider to compress it to a length that will fit within the compartment, then releases to allow the spring's compression force to hold the divider in place.

Applicant has observed several drawbacks of spring-loaded dividers. Springs lose tension over time, causing spring-loaded dividers to become loose over time and move within the compartment. Moreover, because the force necessary to compress a spring is a function of compression distance, the force required to squeeze the divider to a suitable length can become overbearing for narrower compartments. Alternatively, the force holding a spring-loaded divider in place is less and sometimes insufficient for a compartment about the width of the spring-loaded divider.

SUMMARY

The present application discloses compartment dividers that adjust to fit compartments of different sizes and lock in place.

In exemplary embodiments, a divider comprises first and second slide bars, the first slide bar including first and second cooperating surfaces for slideably connecting the second slide bar, and a lock; the second slide bar including first and second cooperating surfaces for slideably connecting the first slide bar to permit sliding and yet resist relative rotational movement of one bar with respect to the other; and wherein the lock when activated prevents the first and second slide bars from sliding inward or outward with respect to each other (locks respective positions of the first and second slide bars).

In some exemplary embodiments, a divider comprises first and second slide bars, the first slide bar including first and second cooperating surfaces for slideably connecting the second slide bar, and a plurality of recesses disposed linearly along a length of the first slide bar; the second slide bar including first and second cooperating surfaces for slideably connecting the first slide bar; a toggle switch rotationally connected to the second slide bar, the toggle switch having at least one locking member; and wherein when the first and second slide bars are slideably connected, and the toggle switch is engaged, the at least one locking member is rotated into at least one recess of the plurality of recesses to lock respective positions of the first and second slide bars.

BRIEF DESCRIPTION OF THE DRAWINGS

These and other features and advantages of the present invention will become better understood with regard to the following description and accompanying drawings in which.

DETAILED DESCRIPTION

As will be described in detail, an expandable partitioning device includes a pair of slide bars. Each slide bar includes a pair of first cooperating surfaces for slideably connecting the other slide bar. The first slide bar has a plurality of recesses along its length. The second slide bar has a rotatable toggle switch with at least one locking member. When the toggle switch is engaged (rotated) the locking member(s) rotate into the recesses of the first slide bar, locking the relative positions of the two slide bars.

Figure 1:
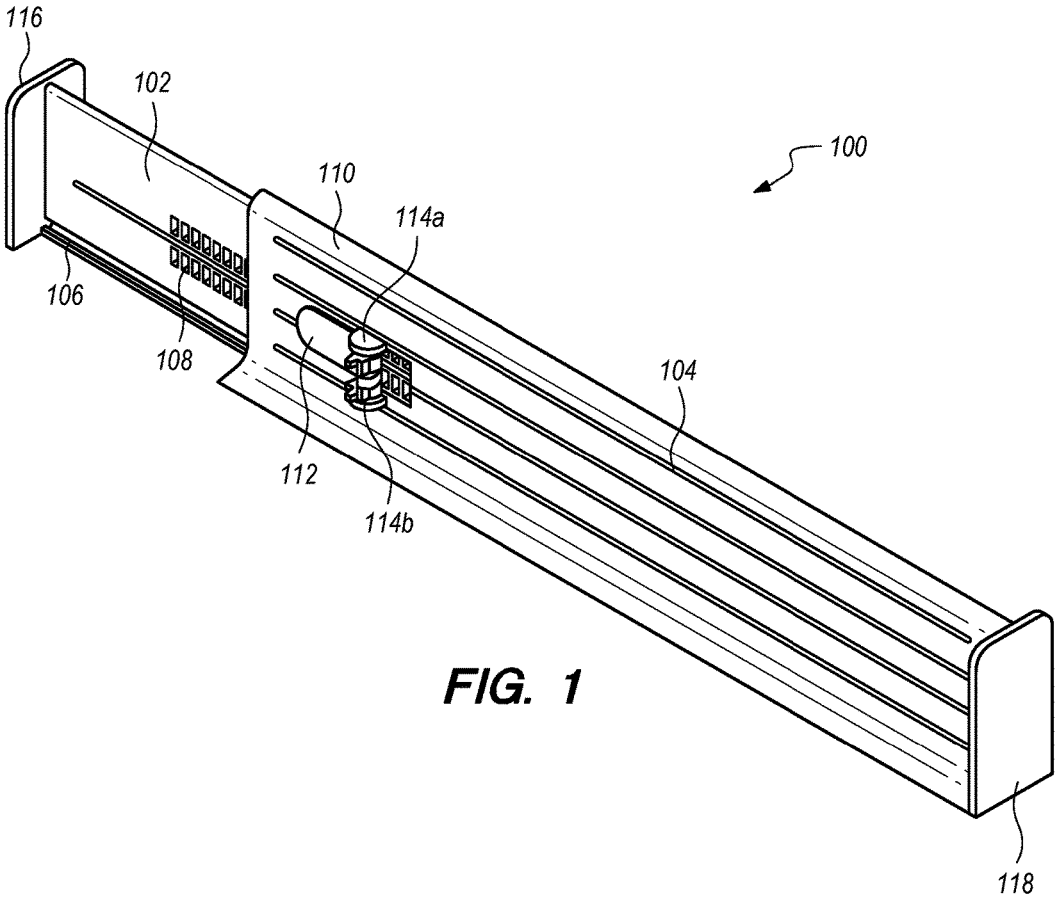
FIG. 1 illustrates an isometric view of an exemplary expandable partitioning device in an unlocked position.

FIG. 1 illustrates an exemplary expandable partitioning device 100. The partitioning device 100 includes a first slide bar 102 and a second slide bar 104. As will be described below in greater detail, the first slide bar 102 includes a first cooperating surface 106 for slideably connecting with a corresponding first cooperating surface of the second slide bar 104. The first slide bar 102 also includes a plurality of recesses 108. The second slide bar 104 includes a second cooperating surface 110 for slideably connecting with a corresponding second cooperating surface of the first slide bar 102. The two pairs of cooperating surfaces inhibit relative rotational motion between the slide bars 102 and 104 when they are connected.

The second slide bar 104 also includes a toggle switch 112 (shown in FIG. 1 in a disengaged position) rotationally (pivotally) connected to the second slide bar 104. The toggle switch 112 has at least one locking member, for example locking members 114*a* and 114*b*. The first and second slide bars 102 and 104 each include an end support member, 116 and 118 respectively, at an end of the slide bar.

Figure 2:
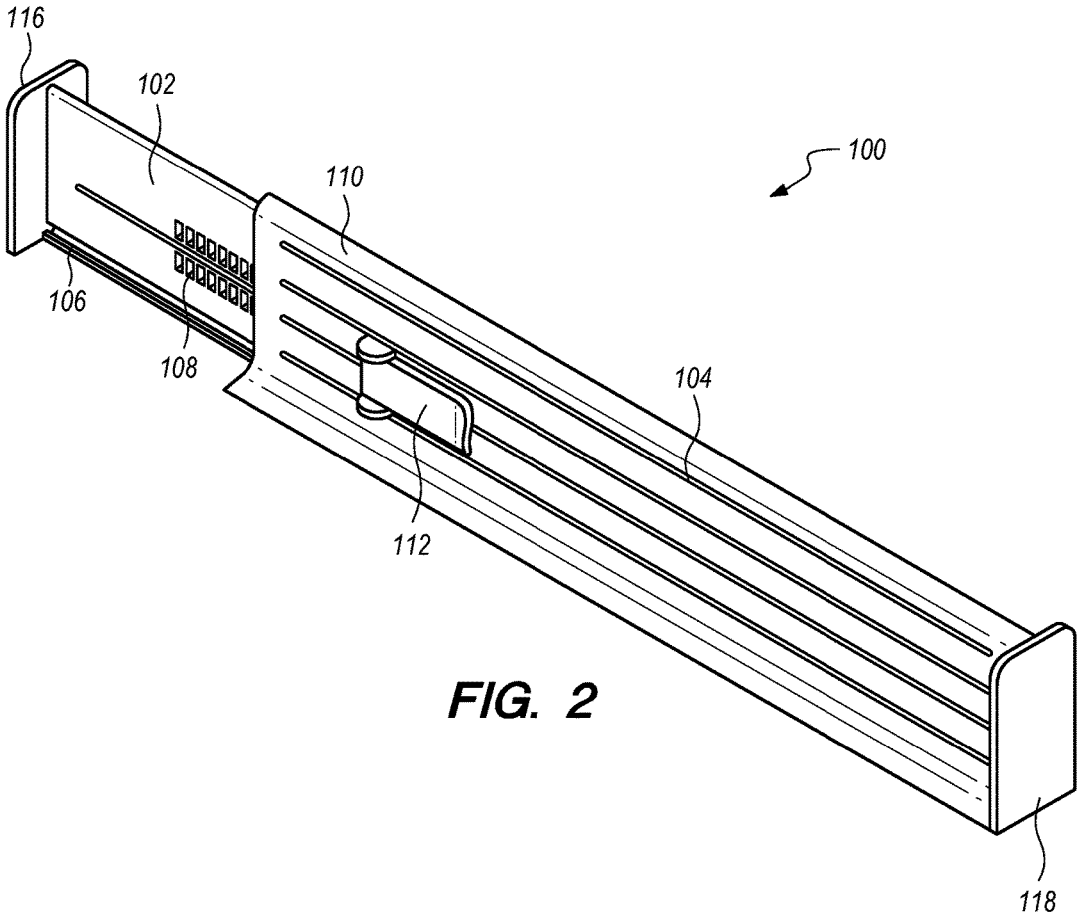
FIG. 2 illustrates an isometric view of an exemplary expandable partitioning device in a locked position.

FIG. 2 illustrates the same exemplary expandable partitioning device 100, but with the toggle switch 112 engaged. When the first slide bar 102 and second slide bar 104 are slideably connected, and the toggle switch 112 is engaged, the locking members 114*a* and 114*b* are rotated into recesses of the plurality of recesses 108 to lock the respective positions of the first and second slide bars 102 and 104.

In an exemplary method of operating the expandable partitioning device 100, the first slide bar 102 and second slide bar 104 are slideably connected with the toggle switch 112 disengaged. The slide bars 102 and 104 are pushed together (i.e., moved into positions relative to each other) such that the total length of the two connected slide bars 102 and 104 is less than width of a compartment to be partitioned. The two connected slide bars 102 and 104 are then placed into the compartment, perpendicular to the walls of the compartment, so that the end support members 116 and 118 are each facing a wall of the compartment. The two slide bars 102 and 104 are then pulled apart to increase the total length of the connected slide bars until both end support members 116 and 118 (or friction pads thereon) are contacting respective sidewalls of the compartment. The toggle switch 112 is then engaged, locking the expandable partitioning device 100 into place within the compartment.

Figure 3:
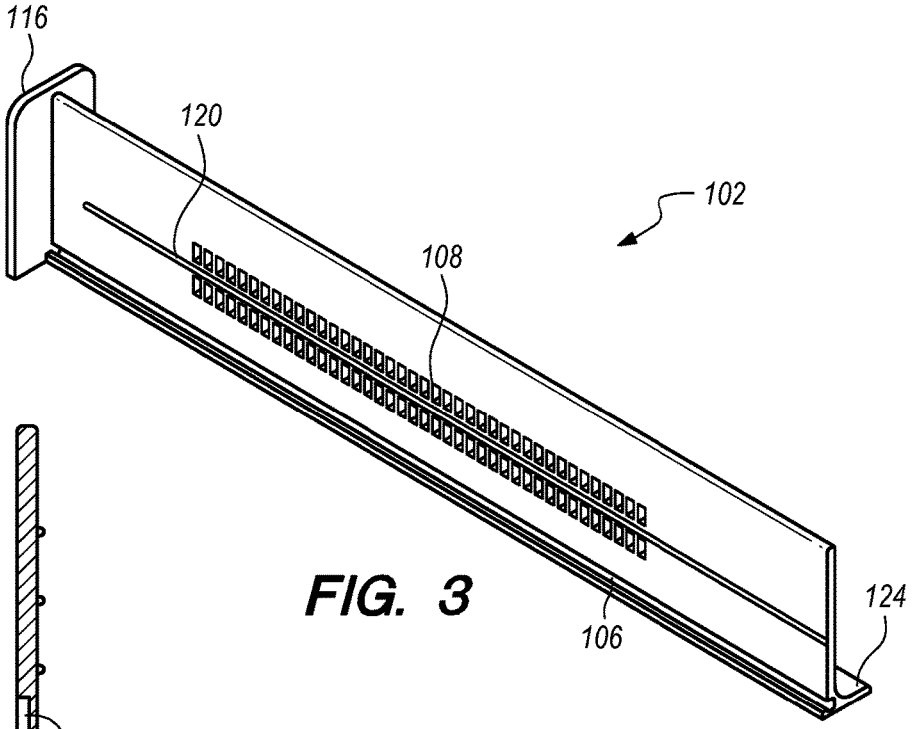
FIG. 3 illustrates an isometric view of an exemplary first slide bar of an expandable partitioning device.
Figure 5:
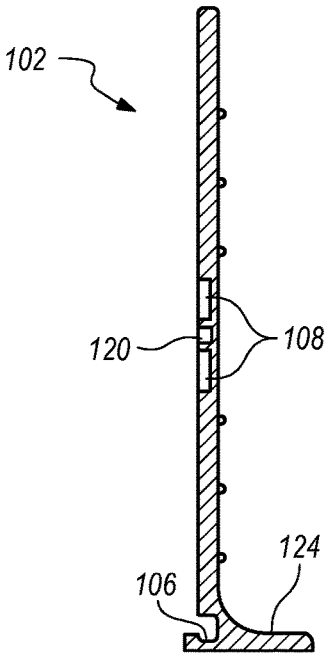
FIG. 5 illustrates a cross-sectional view of the exemplary first slide bar of an expandable partitioning device.
Figure 4:
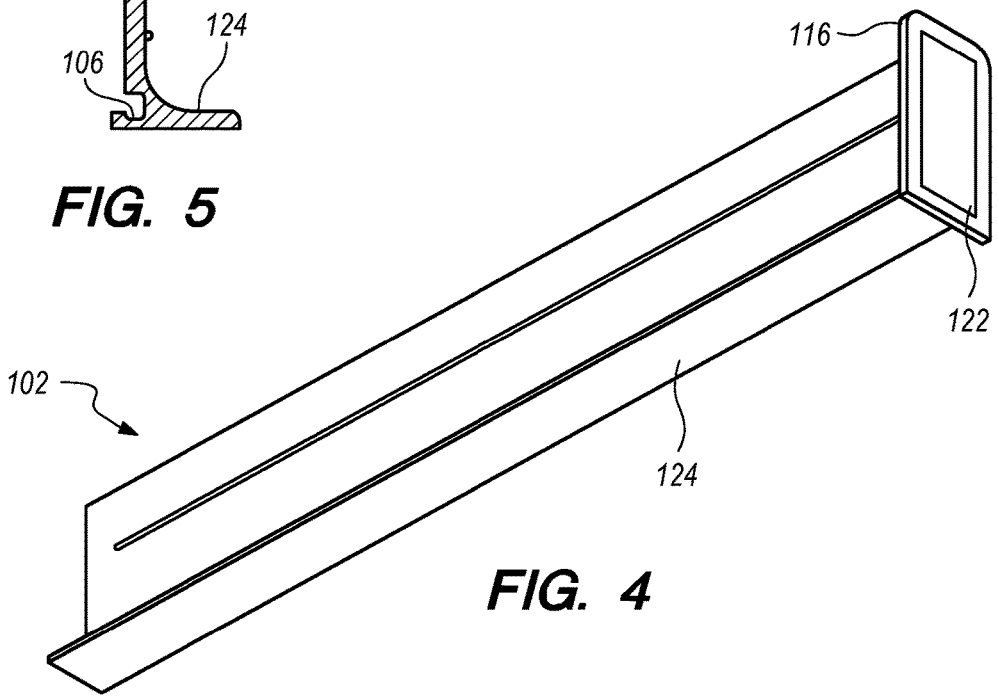
FIG. 4 illustrates another isometric view of the exemplary first slide bar of an expandable partitioning device.

FIGS. 3, 4 and 5 illustrate three views of the first slide bar 102. The first cooperating surface 106 extends along the length of the bottom edge of one side of the first slide bar 102. The first cooperating surface 106 may be, for example, a channel, recess or hole along the length the first slide bar 102. The width of first cooperating surface 106 will depend on the width of a corresponding first cooperating surface of the second slide bar 104 (e.g., a flange member of the second slide bar 104 as described below) that will slideably connect with the first slide bar 102. The width of the first cooperating surface 106 should be large enough such that the corresponding first cooperating surface of the second slide bar 104 can slide through the first cooperating surface 106 without significant friction, yet small enough that the space between the two slide bars does not shift significantly when the when the corresponding first cooperating surface of the second slide bar 104 slides through the first cooperating surface 106 or while the slide bars are connected and/or locked together.

The first slide bar 102 includes a plurality of recesses 108 for receiving at least one locking member of a toggle switch (not shown). In one embodiment the recesses 108 are holes and permeate through the thickness of the first slide bar 102. In one embodiment the recesses 108 penetrate only part way through the thickness of one side of the first slide bar 102. In one embodiment the recesses 108 are disposed in a single row along the length of one side of the first slide bar 102. In one embodiment the recesses are disposed in two or more parallel rows along the length of the slide bar 102. The recesses should be suitably sized and shaped so as to receive a locking member from a toggle switch and firmly hold the member in place when the toggle switch is engaged.

The recesses 108 may be spaced at any suitable distance and may begin and end at any suitable position on the first slide bar 102. The spacing (i.e. frequency) of the recesses will determine the number of locking position of the expandable partitioning device 100. For example, if the recesses 108 are spaced so that there are 50 recesses along the length of the first slide bar 102, then there will be 50 distinct lock positions for the expandable partitioning device 100. In other words, the partitioning device 100 will be adjustable to 50 distinct lengths. Similarly, the beginning and end positions of the recesses 108 will help determine the minimum and maximum length locking positions of the expandable partitioning device 100.

Figure 7:
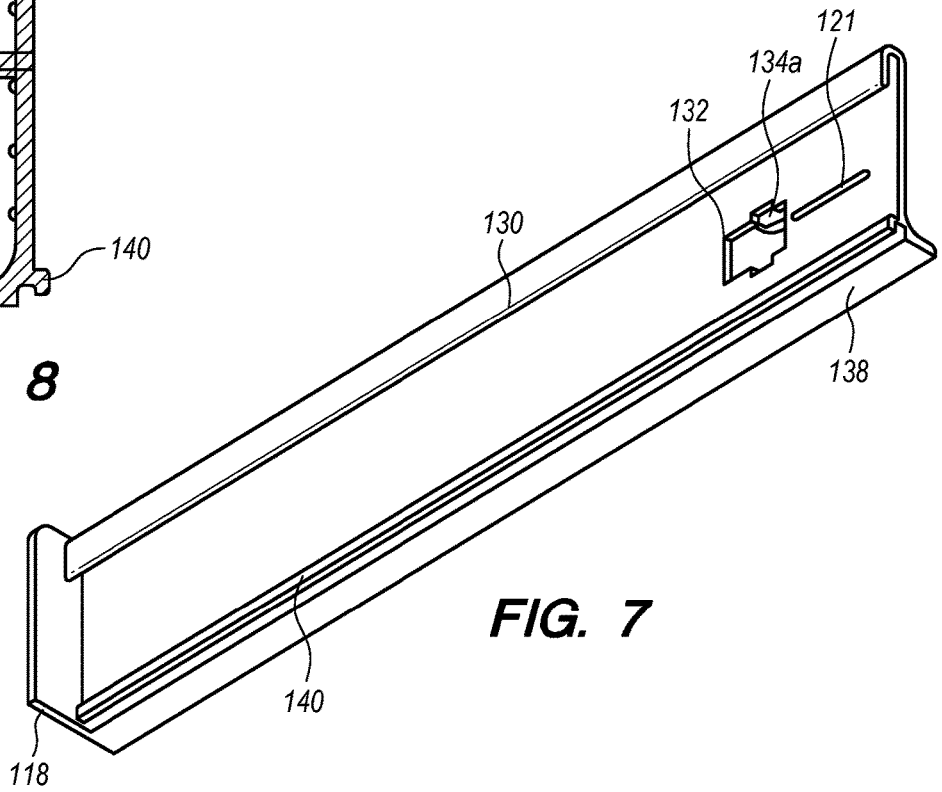
FIG. 7 illustrates another isometric view of the exemplary second slide bar of an expandable partitioning device.

In some embodiments, the first slide bar 102 includes a guide channel 120 for receiving a tapered rib 121 on second slide bar 104 (FIG. 7). The guide channel 120 runs along a length of at least one face of the first slide bar 102, parallel to the any rows of recesses 108. In one embodiment, the guide channel 120 runs between two rows of parallel recesses. The guide channel 120 penetrates only part way through the thickness of the same side of the first slide bar 102 as the recesses 108. The guide channel 120 and tapered rib 121 cooperate to guide the two slide bars 102, 104. Also, the tapered rib 121 acts as a stop to prevent slide bars 102, 104 from separating once assembled.

The first slide bar 102 further includes an end support member 116 at one end of the first slide bar 102. The end support member 116 may be a separate piece attached or connected to the first slide bar 102, or may be molded as a part of the first slide bar 102. The end support member 116 extends laterally out from the first slide bar 102 to form a "T" shape. The end support member 116 provides additional surface area where the ends of the partitioning device 100 would contact the walls of a compartment.

In some embodiments the end support member 116 includes a friction pad 122. The friction pad 122 provides increased friction, especially when compressed, between the walls of a compartment and the end support member 116 so as to decrease movement of the partitioning device 100 within the compartment. The friction pad 122 may also act as cushion, preventing the outward force of the partitioning device 100 from damaging the walls of the compartment. The friction pad 122 may be made of any suitable material, such as, for example, natural or synthetic rubber, foam, or soft polymers, such as closed cell EVA foam (ethylene-vinyl acetate). The friction pad 122 may cover the whole surface of the end support member 116 or any part of it. The friction pad 122 may also be made of several smaller friction pads affixed to the end support member 116. The friction pad may be affixed to the end support member 116 using, for example, any suitable adhesive.

In some embodiments the first slide bar 102 further includes a bottom support member 124 that runs along the bottom edge of first slide bar 102. The bottom support member 124 may be a separate piece attached or connected to the first slide bar 102, or may be molded as a part of the first slide bar 102. In some embodiments the bottom support member 124 extends laterally and perpendicularly in one direction from the first slide bar 102 to form a "L" shape. In some embodiments the bottom support member 124 extends laterally and perpendicularly in both directions from the first slide bar 102 to form a "T" shape. The distance that the bottom support member 124 extends from the first slide bar 102 may be any suitable distance and, if the bottom support member 124 extends from both sides, the lengths on each side may differ. The bottom support member 124 may include the first cooperating surface 106 for slideably connecting the second slide bar 104. The bottom support member 124 provides additional surface area where the bottom of the partitioning device 100 would contact the bottom of a compartment.

Figure 6:
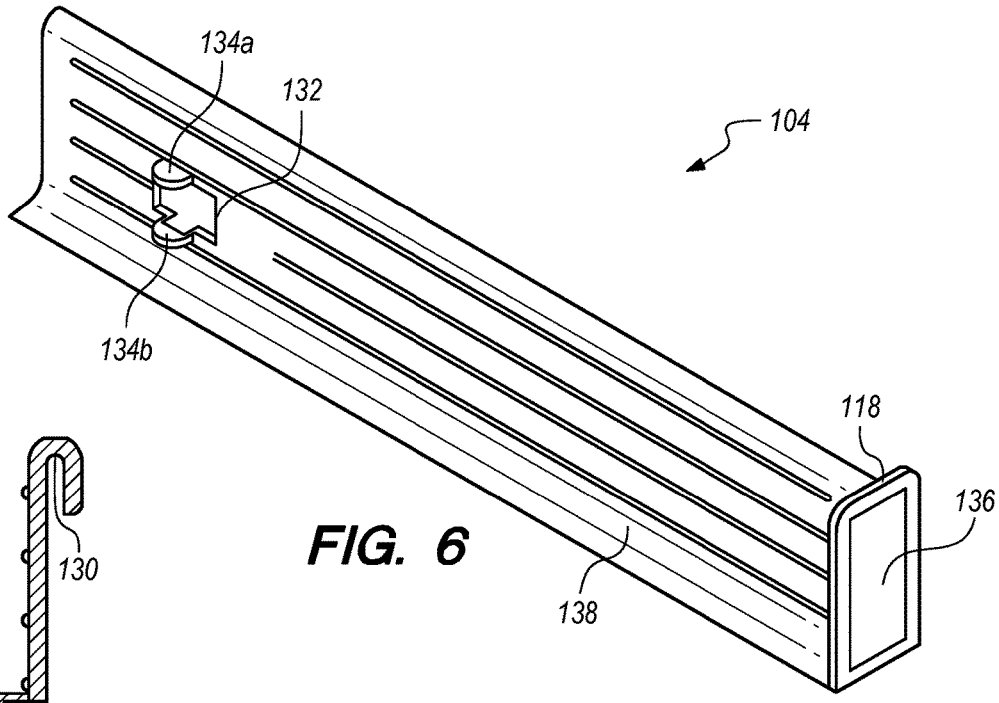
FIG. 6 illustrates an isometric view of an exemplary second slide bar of an expandable partitioning device.
Figure 8:
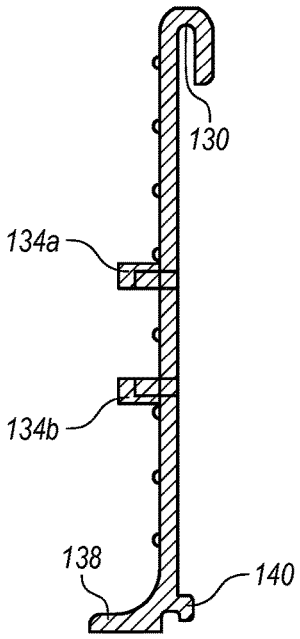
FIG. 8 illustrates a cross-sectional view of the exemplary second slide bar of an expandable partitioning device.

FIGS. 6-8 illustrate three views of the second slide bar 104. A second cooperating surface 130 extends along the length of the top edge of one face of the second slide bar 104. The width of second cooperating surface 130 will depend on the width of a corresponding second cooperating of the first slide bar 102 (e.g., the top edge of the first slide bar 102) that will slideably connect with the second slide bar 104. The width of the second cooperating surface 130 should be large enough such that the corresponding second cooperating surface of the first slide bar 102 can slide through the second cooperating surface 130 without significant friction, yet small enough that the space between the two slide bars does not shift significantly when the when the corresponding second cooperating surface of the first slide bar 102 slides through the second cooperating surface 130 or while the slide bars are connected and/or locked together.

The second slide bar 104 includes a hole 132 through which one or more locking members of a toggle switch will extend, when the toggle switch is engaged, to position the locking member(s) in one or more recesses 108 of the first slide bar 102 and to lock the bars into a fixed position. The hole 130 may be any suitable shape or size, but should be large enough to accept the locking member(s) of the toggle switch when the switch is engaged (e.g. rotated into the hole 130). The hole 130 should thus also be vertically aligned with the recesses of the first slide bar so that the locking member(s) of the toggle switch will move into the recesses 108 when the switch is engaged.

In some embodiments the second slide bar 104 includes a pair of switch connector members, 134*a* and 134*b*, for rotatably connecting a toggle switch. The switch connector members, 134*a* and 134*b* may be located on opposing ends of the hole 130. The switch connector members 134*a* and 134*b* may include recesses for inserting the ends of a pin or rod on which the toggle switch is rotatably mounted. The recesses may have a rectangular shape to allow for slight movement of the toggle switch while the toggle switch is being engaged, and may have one or more angled sides to allow the toggle switch to move slightly away from the first slide bar 102 as the locking members move into the recesses 108 of the first slide bar 102. The switch connector members, 134*a* and 134*b* may also have an opening where they meet the hole 130 for inserting a toggle switch (with a pin or rod) when the second slide bar 104 is not slideably connected to the first slide bar 102.

The second slide bar 104 further includes an end support member 118 at one end of the second slide bar 104, and similar to the end support member 120 described above for the first slide bar 102. Also, the end support member 118 may have a friction pad 136 similar to the friction pad 122 described above for end support member 120.

In some embodiments the second slide bar 104 further includes a bottom support member 138 that runs along the bottom edge of second slide bar 104. The bottom support member 138 may be a separate piece attached or connected to the second slide bar 104, or may be molded as a part of the second slide bar 104. In some embodiments the bottom support member 138 extends laterally and perpendicularly out from the opposite side of the second slide bar 104 as the channel 130 to form a "L" shape.

Figure 11:
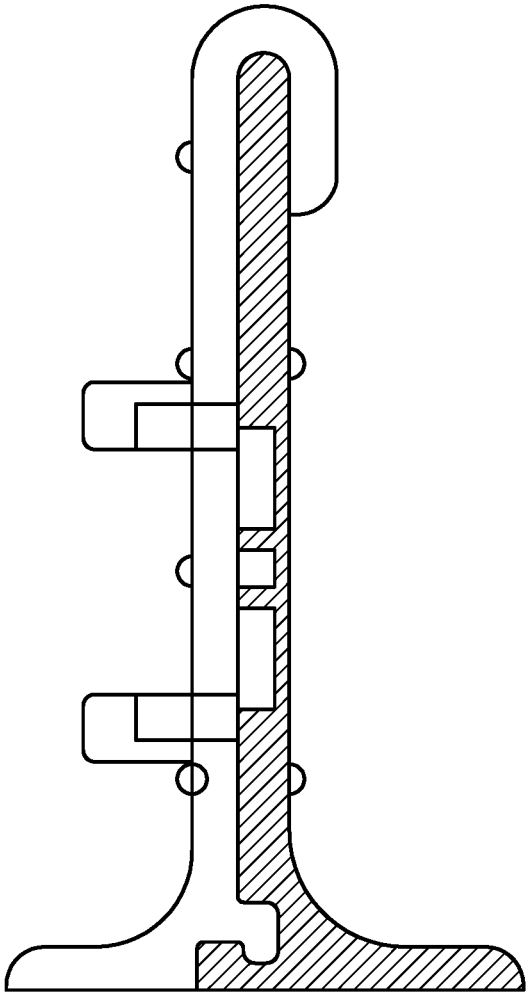
FIG. 11 is a cross-sectional view of the first and second slide bars in cooperative arrangement to permit sliding and yet resist relative rotational movement of one bar with respect to the other.

In some embodiments the first cooperating surface of the second slide bar 104 is a flange member 140 extending lengthwise along the bottom edge of the second slide bar 104 on the same side as the first cooperating surface 130. The flange member 140 may be a separate piece attached or connected to the second slide bar 104, or may be molded as a part of the second slide bar 104. The width of the flange member 140 should small enough to fit within the first cooperating surface 106 of the first slide bar 102 so that the second slide bar 104 can slideably connect with the first slide bar 102. FIG. 11 is a cross-sectional view of the exemplary first and second slide bars 102, 104 in cooperative arrangement to permit sliding and yet resist relative rotational movement of one bar 102, 104 with respect to the other 104, 102. In FIG. 11, the upper end of slide bar 1 is held within the longitudinal channel 130 of slide bar 104 and longitudinal flange 140 of slide bar 104 is held within the longitudinal channel 106 of slide bar 102.

Figure 9:
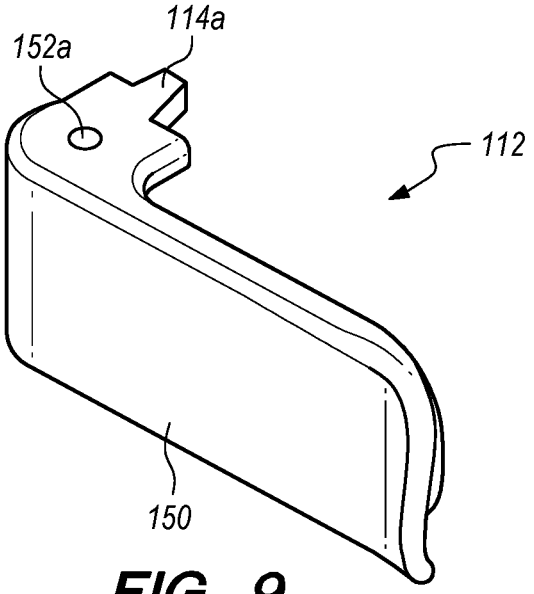
FIG. 9 illustrates an isometric view of an exemplary toggle switch for an expandable partitioning device.
Figure 10:
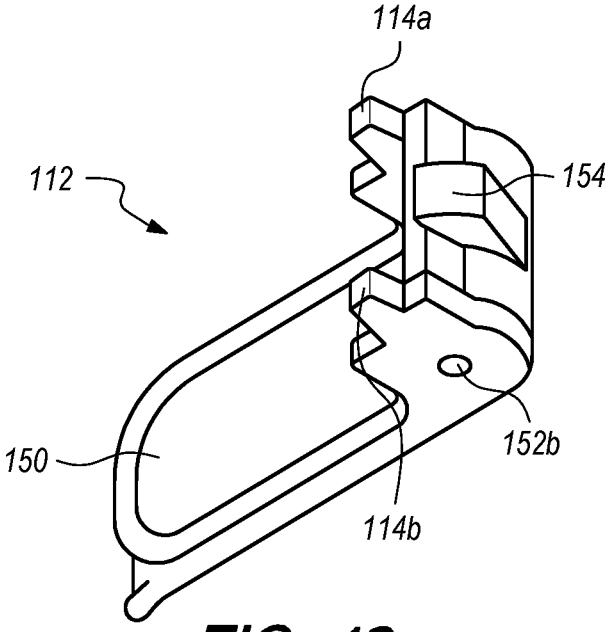
FIG. 10 illustrates another isometric view of the exemplary toggle switch for an expandable partitioning device.

FIGS. 9 and 10 illustrate two views of an exemplary toggle switch 112. The toggle switch 112 includes a switching member 150. The switching member 150 allows a user of the partitioning device 100 to rotate the toggle switch 112, changing between engaged and disengaged positions to lock or unlock the partitioning device 100. The switching member 150 may be any suitable shape or size so as to easily allow a user to flick or rotate the switch 112.

The toggle switch 112 also includes one or more locking members, for example locking members 114*a* and 114*b*. The locking member(s) extend outwardly from the toggle switch 112 so that they may extend into the recesses 108 of the first slide bar 102 when the toggle switch 112 is engaged.

The toggle switch 112 has a pair of holes 152*a* and 152*b* disposed on opposing sides of the toggle switch 112. The holes may receive and hold and pin, rod or the like (not shown) for rotatably connecting the toggle switch 112 to the second slide bar 104. The pin or rod may be secured in the holes 152*a* and 152*b* by a suitable adhesive. In one embodiment, the toggle switch 112 includes, in place of holes, a pair of connecting members, extending outwardly from opposing sides to fit within recesses of switch connector members of the second slide bar 104.

In some embodiments the toggle switch 112 includes a snap member 154. The snap member 154 extends from the rear off the toggle switch 112, between the holes 152*a* and 152*b* and locking members 114*a* and 114*b*, and extends in the same direction as, or at a slight angle from, the locking members 114*a* and 114*b*. The snap member 154 may be larger than the locking members 114*a* and 114*b*, as it need not fit in any recesses when the partitioning device 100 is locked.

As the toggle switch 112 is rotated to engage, the snap member 154 contacts the first slide bar 102 in a space outside of the recesses 108 and applies a pressure against the first slide bar 102. Then if a user of the toggle switch 112 applies only slight force during rotation, the force may not be sufficient to overcome the resisting pressure from the first slide bar 102 and the toggle switch may be prevented from engaging. If the user supplies sufficient force overcome the pressure, the snap member 154 will push past the surface of the first slide bar 102 and "snap" the toggle switch 112 into an engaged (locked) position, with the snap member resting against the surface of the slide bar 102. Similarly, a user may not be able to move the toggle switch from an engaged (locked) position to a disengaged (unlocked) position without applying sufficient pressure to rotatably move the snap member from its position resting against the surface of the first slide bar 102. This mechanism prevents the toggle switch 112 from becoming disengaged without user intervention and thus holds the slide bars in a locked position.

Engaging the toggle switch 112 further causes the expandable partitioning device 100 to expend slightly further. When the toggle switch 112 is "snapped" into its engaged position, the locking members 114*a* and 114*b* are rotated into the recesses 108 of the first slide bar 102. The locking members 114*a* and 114*b* push against the recesses 108 in the direction of the end support member 116 of the first slide bar 102. The force of the locking members 114*a* and 114*b* causes a slight outward expansion before the positions of the bars are locked, further securing the expandable partitioning device 100 with a compartment.

The slide bars 102, 104 and the toggle switch 112 can be molded from any suitable polymer material, e.g., polyethylene terephthalate (PET), acrylonitrile butadiene styrene (ABS), or polypropylene (PP). The pin or rod holding the toggle switch 112 in place can be made of any of several suitable materials, e.g., stainless steel, steel, brass, or aluminum.

While the present invention has been illustrated by the description of embodiments thereof and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and/or illustrative examples shown and described. Accordingly, departures may be made from such details without departing from the spirit or scope of the applicants' general inventive concept.

We claim:

1. A partitioning device for partitioning a compartment, the partitioning device comprising, first and second slide bars, the first slide bar including first and second cooperating surfaces for slideably connecting the second slide bar, and a plurality of recesses disposed linearly along a length of the first slide bar; and the second slide bar including a bottom support providing a surface where a bottom of the partitioning device contacts a bottom of the compartment, first and second cooperating surfaces for slideably connecting the first slide bar; and a toggle switch rotationally connected to the second slide bar, the toggle switch having at least one locking projection; and wherein when the first and second slide bars are slideably connected, and the toggle switch is engaged, the at least one locking projection is rotated into at least one recess of the plurality of recesses to lock respective positions of the first and second slide bars, thereby preventing the first and second slide bars from sliding inward or outward with respect to each other; and wherein as the at least one locking projection is rotated into the at least one recess of the plurality of recesses to lock respective positions of the first and second slide bars, the at least one locking projection causes an outward expansion of the partitioning device before the positions of the first and second slide bars are locked, further securing the partitioning device within the compartment; and wherein the toggle switch further comprises another surface that applies a pressure against the first slide bar outside the recesses when the toggle switch is engaged.

2. The device of claim 1 further comprising a first friction pad affixed to an end support member of the first slide bar and a second friction pad affixed to an end support member of the second slide bar.

3. The device of claim 1, the plurality of recesses comprising two parallel rows of recesses and the toggle switch rotating on a vertical axis and comprising two of the at least one locking projections, each locking projection rotating into a respective recess of the plurality of recesses of the two parallel rows of recesses to lock respective positions of the first and second slide bars.

4. The device of claim 3, the another surface of the toggle switch comprising a surface that contacts a portion of the first slide bar between the recesses when the toggle switch is engaged and applies a pressure against the first slide bar when the toggle switch is engaged.

5. The device of claim 3, the another surface of the toggle switch comprising a snap surface that contacts a portion of the first slide bar between the recesses when the toggle switch is engaged and applies a pressure against the first slide bar when the toggle switch is engaged.

6. The device of claim 1, the first slide bar further including a bottom support providing a surface where the bottom of the partitioning device contacts the bottom of the compartment.

7. The device of claim 1, wherein the first and second cooperating surfaces of the first and second slide bars inhibit relative rotational movement between the first and second slide bars when the first and second slide bars are slideably connected.

8. The device of claim 1, the another surface of the toggle switch comprising a snap surface that contacts a portion of the first slide bar outside of the recesses when the toggle switch is engaged and applies a pressure against the first slide bar when the toggle switch is engaged.

9. The device of claim 1, wherein the first and second slide bars cooperate to permit sliding and yet resist relative rotational movement with respect to one another.

10. The device of claim 1, the second slide bar comprising a U-shaped portion extending along its top edge that accepts and slides against a top edge of the first slide bar.

11. A method of partitioning a drawer having at least two side walls and width between the side walls, the method comprising:

providing a divider having first and second slideably connected slide bars, the first slide bar including a first and second cooperating surfaces for slideably connecting the second slide bar and a plurality of recesses disposed linearly along a length of the first slide bar; and the second slide bar including a bottom support providing a surface where a bottom of the divider contacts a bottom of the drawer, first and second cooperating surfaces for slideably connecting the first slide bar; and a toggle switch rotationally connected to the second slide bar, the toggle switch having at least one locking projection; and wherein when the first and second slide bars are slideably connected, and the toggle switch is engaged, the at least one locking projection is rotated into at least one recess of the plurality of recesses to lock respective positions of the first and second slide bars, thereby preventing the first and second slide bars from sliding inward or outward with respect to each other; and further wherein as the at least one locking projection is rotated into at least one recess of the plurality of recesses to lock respective positions of the first and second slide bars, the at least one locking projection causes an outward expansion of the divider before the positions of the first and second slide bars are locked, further securing the divider within the drawer;

inserting the connected first and second slide bars into the drawer perpendicularly to the side walls with the bottom support of the divider contacting the bottom of the drawer;

altering the relative positions of the first and second slide bars so that each of the connected first and second slide bars is contacting one side wall of the drawer;

with the bottom support of the divider contacting the bottom of the drawer, rotating a toggle switch to cause an outward expansion of the divider before the positions of the first and second slide bars are locked and then lock the relative positions of the first and second slide bars.

12. The method of claim 11, wherein the toggle switch is rotatably connected to the second slide bar for rotation on a vertical axis and rotating the toggle switch causes the at least one locking projection of the toggle switch to rotate into the at least one recess of the first slide bar.

13. The method of claim 11, wherein the toggle switch is rotatably connected to the second slide bar and rotating the toggle switch with sufficient force causes a snap surface of the toggle switch to push against and slide across the first slide bar.

14. The method of claim 11, wherein the first and second slide bars cooperate to permit sliding and yet resist relative rotational movement with respect to one another.

15. The method of claim 11, the toggle switch comprising another surface that contacts a portion of the first slide bar outside of the recesses when the toggle switch is engaged and wherein the step of rotating the toggle switch causes the another surface to apply a pressure against the first slide bar.

16. The method of claim 11, the toggle switch comprising a snap surface that contacts a portion of the first slide bar outside of the recesses when the toggle switch is engaged and wherein the step of rotating the toggle switch causes the snap surface to apply a pressure against the first slide bar.

17. The method of claim 11, the second slide bar comprising a U-shaped portion extending along its top edge that accepts and slides against a top edge of the first slide bar.

18. A partitioning device for partitioning a compartment, the partitioning device comprising, first and second slide bars, the first slide bar including first and second cooperating surfaces for slideably connecting the second slide bar, and a plurality of recesses disposed linearly along a length of the first slide bar; and the second slide bar including first and second cooperating surfaces for slideably connecting the first slide bar; and a toggle switch rotationally connected to the second slide bar, the toggle switch having at least one locking projection; and wherein when the first and second slide bars are slideably connected, and the toggle switch is engaged, the at least one locking projection is rotated into at least one recess of the plurality of recesses to lock respective positions of the first and second slide bars, thereby preventing the first and second slide bars from sliding inward or outward with respect to each other; and further wherein the toggle switch comprises another surface that contacts a portion of the first slide bar outside of the recesses when the toggle switch is engaged and applies a pressure against the first slide bar when the toggle switch is engaged.

19. The device of claim 18, the another surface of the toggle switch comprising a snap surface that contacts a portion of the first slide bar outside the recesses when the toggle switch is engaged and applies a pressure against the first slide bar when the toggle switch is engaged.

20. The device of claim 18, the second slide bar comprising a U-shaped portion extending along its top edge that accepts and slides against a top edge of the first slide bar.

* * * * *